US008839777B1

(12) United States Patent
Webb et al.

(10) Patent No.: US 8,839,777 B1
(45) Date of Patent: Sep. 23, 2014

(54) BOWSTRING SILENCER

(71) Applicant: TruGlo, Inc., Richardson, TX (US)

(72) Inventors: Gregory A. Webb, Garland, TX (US); John Estridge, Plano, TX (US); Anthony T. LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 63 days.

(21) Appl. No.: 13/734,613

(22) Filed: Jan. 4, 2013

(51) Int. Cl.
*F41B 5/00* (2006.01)
*F41B 5/14* (2006.01)

(52) U.S. Cl.
CPC ..... *F41B 5/1407* (2013.01)
USPC ..... 124/92

(58) Field of Classification Search
CPC ..... F41B 5/1407; F41B 5/1515
USPC ..... 124/89, 90, 91, 92
See application file for complete search history.

(56) References Cited

U.S. PATENT DOCUMENTS

| | | | |
|---|---|---|---|
| 3,059,629 | A | 10/1962 | Stinson |
| 3,584,615 | A | 6/1971 | Stinson |
| 3,597,803 | A | 8/1971 | Van Neil |
| 3,612,029 | A | 10/1971 | Carroll |
| 3,837,327 | A | 9/1974 | Saunders et al. |
| 5,016,604 | A | 5/1991 | Tilby |
| 6,044,526 | A | 4/2000 | Putney |
| 6,237,584 | B1 | 5/2001 | Sims |
| 6,446,620 | B1 | 9/2002 | Summers et al. |
| 6,761,158 | B2 | 7/2004 | Wright |
| D628,669 | S | 12/2010 | McPherson |
| D628,670 | S | 12/2010 | McPherson |
| D661,363 | S | 6/2012 | McPherson |
| 2010/0154769 | A1 | 6/2010 | Grace, Jr. |
| 2011/0094489 | A1 | 4/2011 | McPherson |

*Primary Examiner* — John Ricci
(74) *Attorney, Agent, or Firm* — Alvin R. Wirthlin

(57) ABSTRACT

A bowstring silencer for mounting to a bowstring, buss cable or the like, includes a central body portion and a pair of arm portions that extend in opposite directions from the central body portion. A locking flange is associated with one of the arm portions and is adapted to extend through an opening in the central body portion when the silencer is installed. The first and second arm portions extend asymmetrically with respect to the central body portion prior to attachment to a bowstring, buss cable or the like, and extend at least generally symmetrically after attachment thereto.

15 Claims, 4 Drawing Sheets

BOWSTRING SILENCER

RELATED APPLICATIONS

This application is related to U.S. Design Application No. 29/441,443, filed on Jan. 4, 2013, now U.S. Design Pat. No. D702,795 issued on Apr. 15, 2014, the disclosure of which is hereby incorporated by reference.

BACKGROUND OF THE INVENTION

This invention relates generally to bow strings, and more particularly to bowstring silencers that can be easily attached by hand to the bowstring of an archery bow.

When an arrow is launched from the bowstring of an archery bow, the string tends to generate noise, primarily as a result of vibration induced in the bowstring during release of the arrow. In order to counteract this effect, bowstring silencers of various types have been used heretofore to dampen the vibration of the bowstring resulting from arrow launch. One prior art string silencer that is commercially available is commonly known as "puff string silencer" or "puff". This device is embodied as a soft ball installed by separating the strands of a bowstring and inserting ties connected to the puff. Another commercially available string silencer is known as the "cat whisker" and includes a plurality of thin rubber appendages extending from a body and tied to the bowstring. String silencers currently in use are intended to dampen vibration and reduce noise without negatively impacting performance of the bow. However, although such devices are generally effective, they have certain drawbacks, particularly under certain conditions. For example, arrow velocity appears to be negatively affected in most bows equipped with any of the currently available silencers. Silencers, such as puffs, which are constructed of yarn or other water absorptive fabrics, are less effective in damp or wet weather, and require the use of a bow press for their installation and removal. Other silencers require hand tools for installation and adjustment. Yet other string silencers can be bulky and/or asymmetric, thereby negatively affecting bow performance.

It would therefore be desirous to provide a string silencer that performs well in various weather conditions, is lightweight and symmetrical when installed to minimize negative effects on arrow velocity and bow performance, and is easy to install by hand.

BRIEF SUMMARY OF THE INVENTION

According to one aspect of the invention, a bowstring silencer for mounting to a bowstring, buss cable or the like includes a central body portion having an opening with a first diameter; a first arm portion connected to the central body portion; a second arm portion connected to an opposite side of the central body portion; and a locking flange positioned between the central body portion and the first arm portion. The flange has a second diameter larger than the first diameter such that the first arm portion can be wrapped around the bowstring and inserted into the opening with the locking flange passing therethrough to thereby lock the first arm portion to the central body portion and secure the bowstring silencer around the bowstring, buss cable or the like.

According to a further aspect of the invention, a bowstring silencer for mounting to a bowstring, buss cable or the like, includes a central body portion having an opening with a first diameter; a first base extending from one side of the central body portion, the first base having an annular groove that receives the bowstring, buss cable or the like during installation and wraps therearound when installed thereon; a locking flange extending from the base portion and having a second diameter larger than the first diameter such that the first base portion can be wrapped around the bowstring and inserted into the opening with the locking flange passing therethrough to thereby lock the first base to the central body portion and secure the bowstring silencer around the bowstring, buss cable or the like; a first arm portion connected to the locking flange and curving downwardly and to the left therefrom; and a second arm portion connected to an opposite side of the central body portion and curving downwardly and to the right therefrom. The first and second arm portions extend asymmetrically with respect to the central body portion prior to attachment to a bowstring, buss cable or the like, and extend symmetrically after attachment thereto.

According to yet a further aspect of the invention, a method of installing a bowstring silencer on a bowstring, buss cable or the like, includes providing a bowstring silencer with a central body portion having an opening, a first arm portion extending from one side of the central body portion and having a base and a locking flange greater in diameter than the opening, and a second arm portion extending from another side of the central body portion; wrapping the base around the bowstring, buss cable or the like; inserting the first arm portion into the opening; and pulling on the first arm portion until the locking flange clears the opening and locks the first arm portion to the central body portion such that the first and second arm portions are generally symmetrical about the central body portion.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 8:
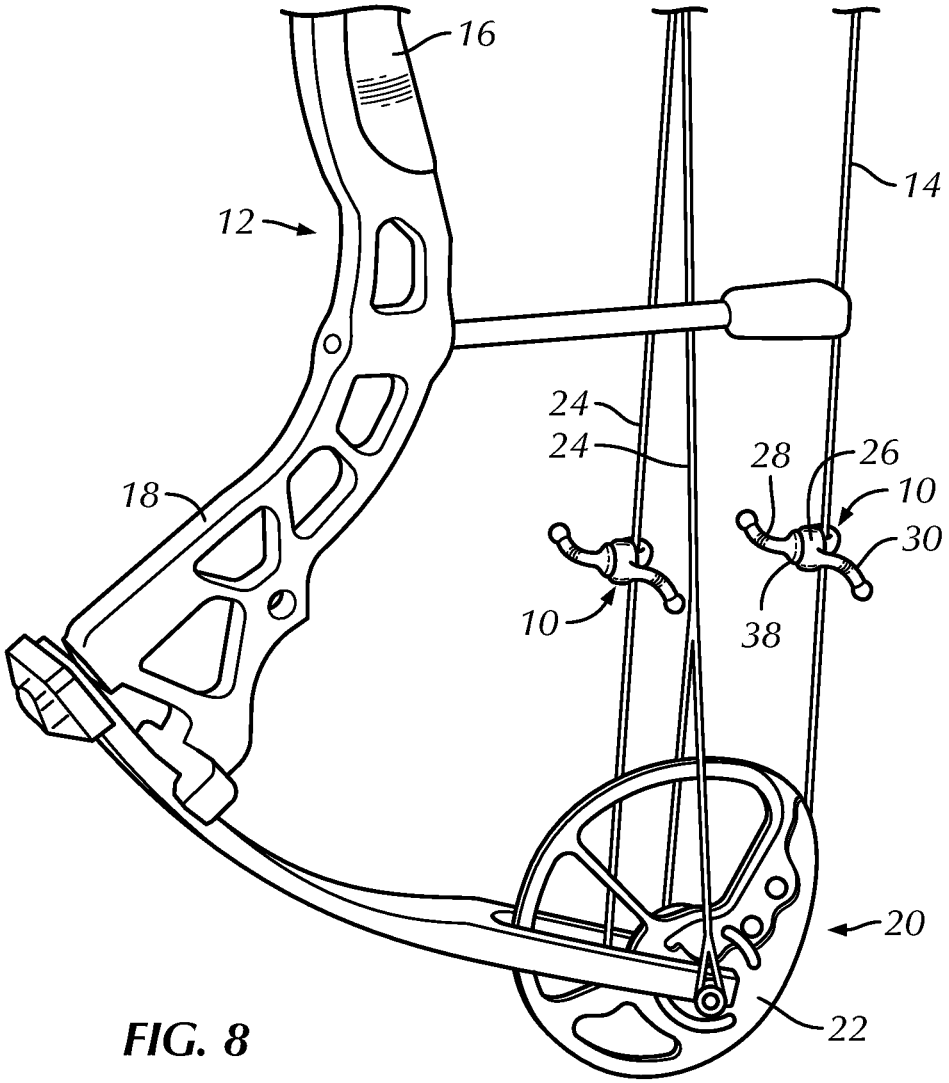
FIG. 8 is an isometric view of a lower portion of a compound bow showing the bowstring silencer connected to a bowstring in accordance with the invention.

Referring now to FIGS. 1-8 of the drawings, a bowstring silencer 10 in accordance with the present invention is shown. In FIG. 8, the bowstring silencer 10 is shown connected to the bowstring 14 of a compound bow 12. The compound bow 12 is for illustration purposes only since the bowstring silencer 10 of the present invention can be adapted for use with any type of bow including, but not limited to, crossbows, recurve bows, reflex bows, longbows, and so on.

The compound bow 12 includes a riser 16 with a first limb portion 18 and second limb portion (not shown) extending outwardly therefrom in generally opposite directions. A first rotation assembly 20 and a second rotation assembly (not shown) are rotatably mounted on first and second limb portions, respectively. As shown, the first rotation assembly 20 includes a cam 22 rotatably mounted to a distal end of the first limb portion 18. The bowstring 14 wraps around the first and second rotation assemblies and is subjected to noise and vibration when released after being in a drawn position. In order to effectively reduce noise and/or vibration in the bowstring, one or more bowstring silencers 10 of the present invention can be installed at various locations along its length between the rotation assemblies. In addition, one or more of the bowstring silencers 10 can be installed at various locations along one or more of the buss cables 24 as shown.

The bowstring silencer 10 is preferably of a single-piece molded construction formed of an elastomeric material, such as thermoplastic elastomer, reinforced silicon rubber, and so on, having a Shore A hardness in the range of approximately 30-50 and more preferably in the range of 45-50. The bowstring silencer preferably includes a central body portion 26 with an opening 36, a first base 29 that extends from the central body portion and a first arm portion 28 that extends from the first base 29, a second base 32 that extends from the central body portion and a second arm 30 that extends from the second base 32. The first base preferably extends in a first direction from the central body portion 26 and the second base 32 preferably extends in a second opposite direction from the central body portion 26. Preferably, the first and second directions are radial directions and are oriented 180 degrees apart such that the first base is oriented at the 3 O'clock position and the second base is oriented at the 9 O'clock position. It will be understood that the first and second bases can be oriented at other positions without departing from the spirit and scope of the invention. The opening 36 is formed in the central body portion 26 and is sized for receiving the first arm 28 and first base 29 when the bowstring silencer 10 is mounted on a bowstring, buss cable, or the like.

The first base 29 preferably includes an annular groove 34 that is preferably equal to or less than the diameter of the opening 36 and also is adaptable to receive the bowstring, buss cable or the like during installation and use. However, it will be understood that the annular groove 34 can have a diameter greater than the diameter of the opening 36. It will be further understood that the annular groove 34 can be eliminated without departing from the spirit and scope of the invention.

An annular locking flange 38 extends radially outwardly from the base 29 and has an inner surface 40 that faces the central body portion 26 and an outer sloped surface 42 that slopes towards the first arm portion 28. The flange 38 is preferably greater in diameter than the opening 36 so that the base 29 is held securely in the opening 36 of the central body portion 26 when mounted on a bowstring, buss cable, or the like.

Figure 1:
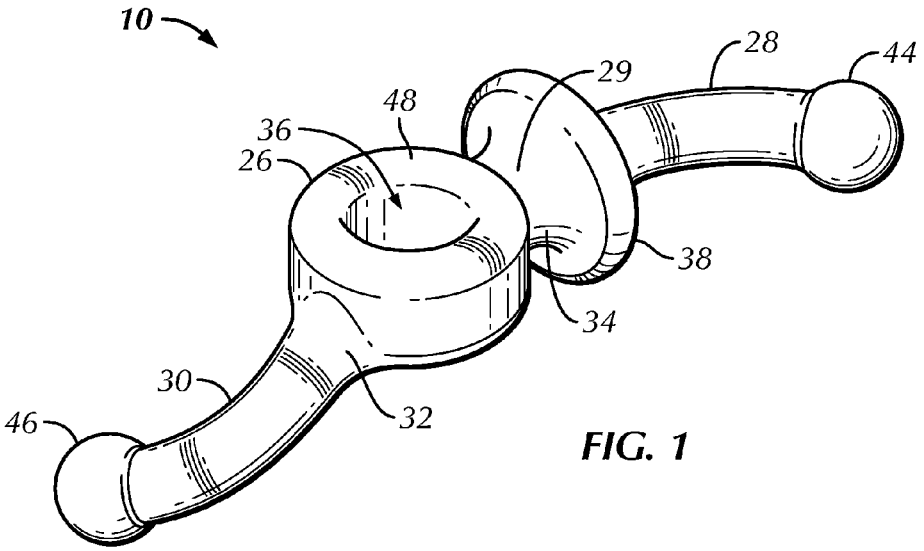
FIG. 1 is an isometric view of a bowstring silencer in accordance with the present invention.
Figure 2:
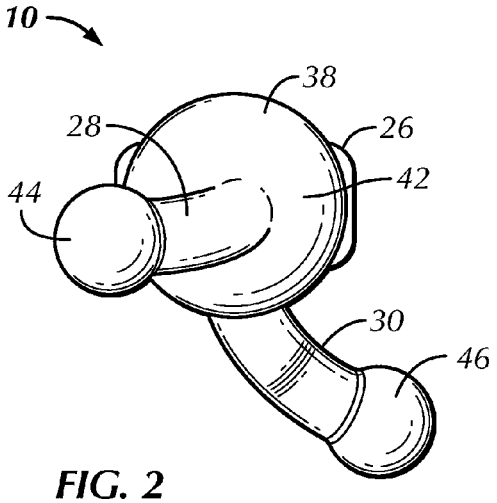
FIG. 2 is a front elevational view thereof.
Figure 3:
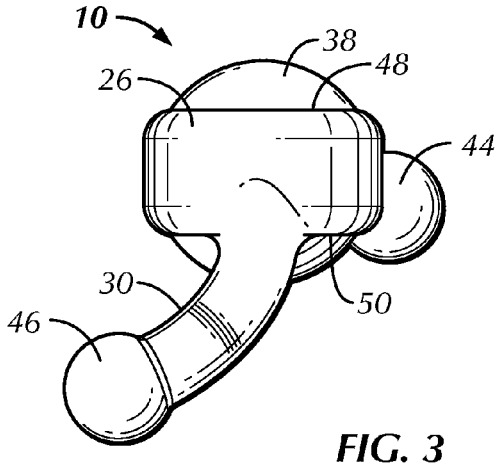
FIG. 3 is a rear elevational view thereof.
Figure 4:
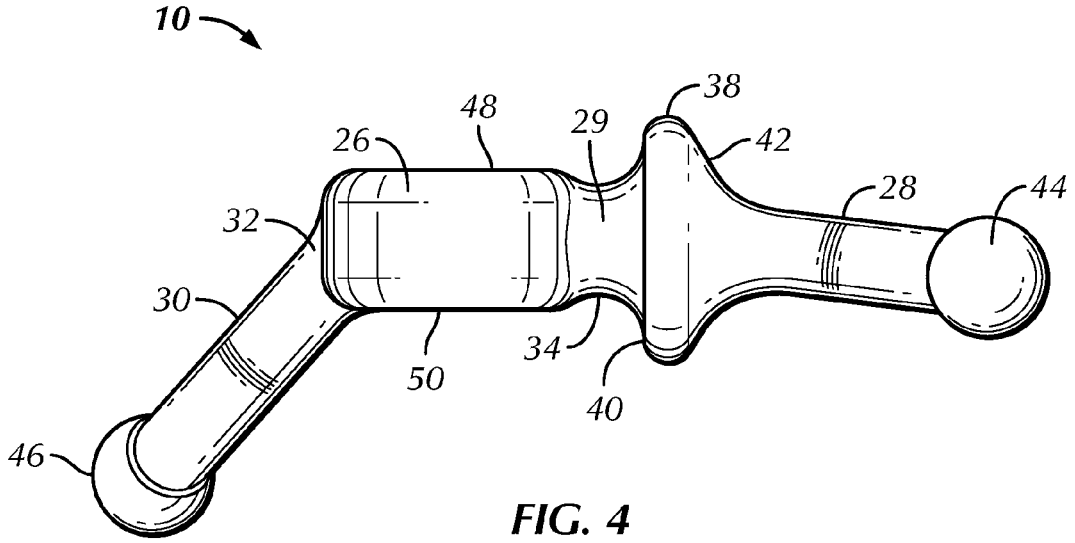
FIG. 4 is a left side elevational view thereof.
Figure 5:
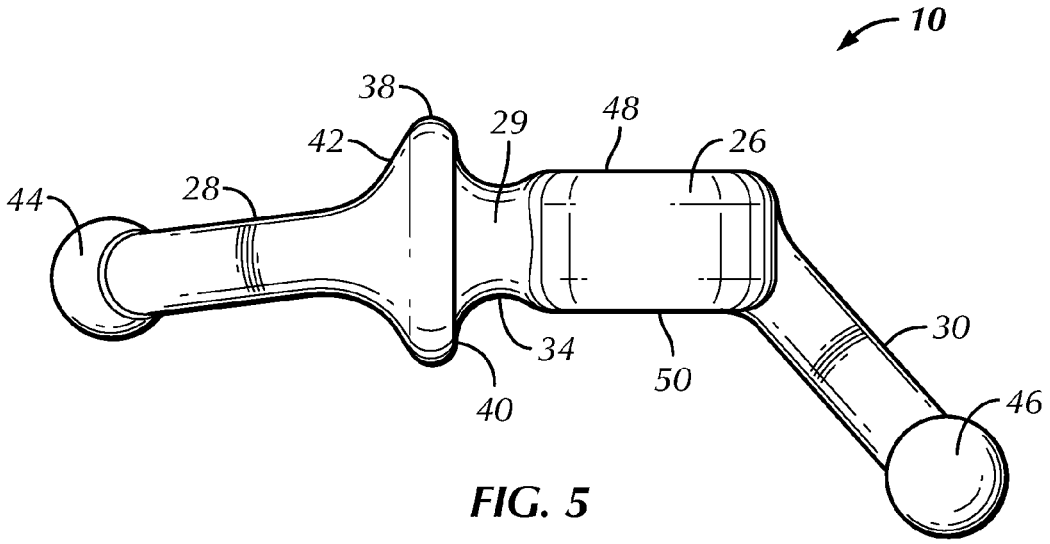
FIG. 5 is a right side elevational view thereof.
Figure 6:
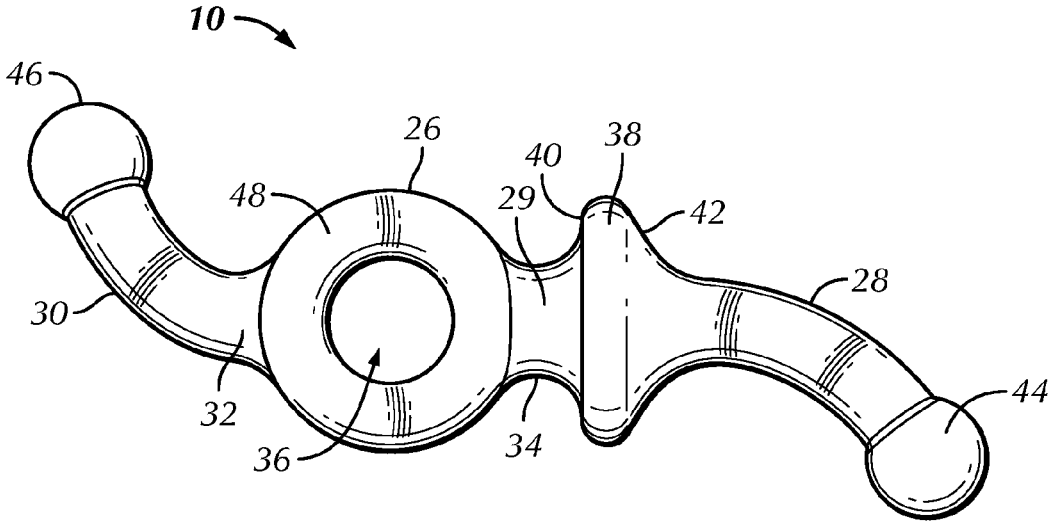
FIG. 6 is a top plan view thereof.
Figure 7:
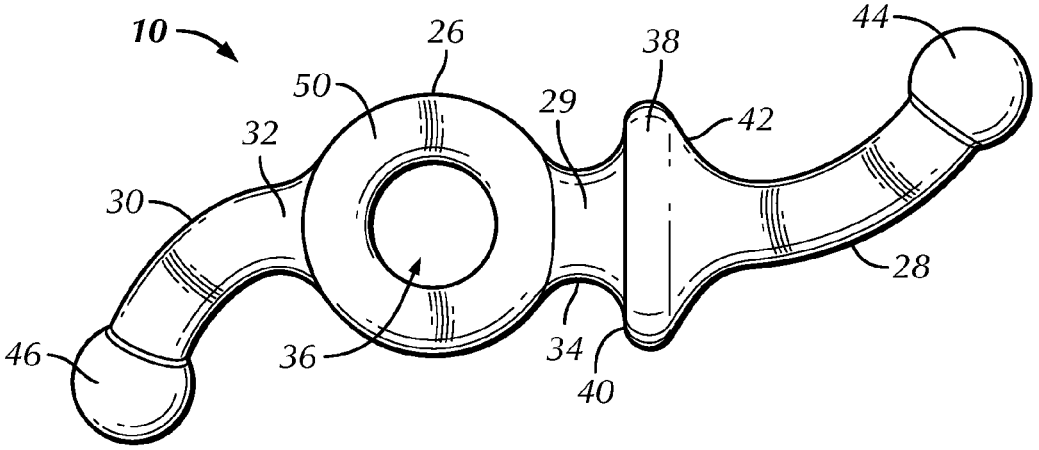
FIG. 7 is a bottom plan view thereof.

The first arm portion 28 extends from the flange 38 and curves downwardly, as shown in FIG. 6, and also curves to the left, as shown in FIG. 2. A first tip 44, shown in the form of a sphere, is located at the outer free end of the first arm portion 28. The tip 44 helps to absorb vibration when installed and also facilitates installation of the bowstring silencer 10 because of its larger gripping area than the surrounding first arm portion 28. Preferably, the diameter of the tip 44 is equal to or less than the diameter of the opening 36 of the central body portion 26.

The second arm portion 30 preferably curves upwardly, as shown in FIG. 6, and also curves to the right, as shown in FIG. 2. A second tip 46, shown in the form of a sphere, is located at the outer free end of the first arm portion 28. The tip 46 helps to absorb vibration when installed and also facilitates installation of the bowstring silencer 10 because of its larger gripping area than the surrounding second arm portion 30. Preferably the diameter of the second tip 46 is equal to the diameter of the first tip 44.

It will be understood that one or more of the tips 44, 46 can be of different sizes and/or shapes, or may be eliminated without departing from the spirit and scope of the invention.

During installation of the bowstring silencer 10 on the bowstring 14, buss cable 24, or the like, and with further reference to FIG. 8, the annular groove 34 of the first base 29 is placed against the bowstring or cable. The first arm portion 28 is then grasped by a user and wrapped around the bowstring or cable. The tip 44 is then inserted through the opening 36 of the central body portion 26 until it protrudes sufficiently on the opposite side of the central body portion 26. The user then grasps the tip 44 and pulls until the annular locking flange 38 is pulled completely through the opening 36 with the outer surface 42 of the flange 38 engaging one of the outer surfaces 48, 50 of the central body portion 26, depending on which direction the first arm portion 28 is wrapped around the bowstring or the like, with the annular groove 34 of the first base member 29 encircling the bowstring or the like. During the pulling step, the user can pull both the first and second arm portions in opposite directions, which greatly facilitates installation over prior art arrangements. The bowstring silencer has sufficient resiliency to permit the larger locking flange 38 to pass through the smaller opening 36. The bowstring silencer 10 is also elongated during pulling to create an elastic bias to thereby securely hold or lock the first arm portion 28 with respect to the central body portion 26, and also to firmly hold the bowstring silencer 10 on the bowstring 14 or the like during shooting when the first and second arm portions are released by the user.

The asymmetric nature of the first and second bases and arm portions together with the curvatures of the first and second arm portions ensure that the first and second arm portions extend outwardly in opposite directions when tied or secured to the bowstring or the like, as shown in FIG. 8, in a symmetric or generally symmetric manner. The symmetric nature of the installed bowstring silencer more effectively reduced vibration and consequent shooting inaccuracies that may occur with other prior art string silencer solutions.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. A bowstring silencer for mounting to a bowstring, buss cable or the like, comprising:

a central body portion having an opening with a first diameter;

a first arm portion connected to the central body portion;

a second arm portion connected to an opposite side of the central body portion; and a locking flange positioned between the central body portion and the first arm portion, the flange having a second diameter larger than the first diameter such that the first arm portion can be wrapped around the bowstring and inserted into the opening with the locking flange passing therethrough to thereby lock the first arm portion to the central body portion and secure the bowstring silencer around the bowstring, buss cable or the like.

2. A bowstring silencer according to claim 1, wherein the first and second arm portions extend asymmetrically prior to attachment to a bowstring, buss cable or the like, and extend symmetrically subsequent to attachment thereto.

3. A bowstring silencer according to claim 2, wherein the first arm portion curves downwardly and to the left and the second arm portion curves upwardly and to the right.

4. A bowstring silencer according to claim 1, and further comprising:

a first base extending from the central body portion with the first arm portion connected to the first base.

5. A bowstring silencer according to claim 4, wherein the first base comprises an annular groove that receives the bowstring, buss cable or the like during installation and wraps around the bowstring, buss cable or the like when installed thereon.

6. A bowstring silencer according to claim 5, wherein the locking flange is positioned between the first arm portion and the base.

7. A bowstring silencer according to claim 6, wherein the first and second arm portions extend asymmetrically prior to attachment to a bowstring, buss cable or the like, and extend symmetrically subsequent to attachment thereto.

8. A bowstring silencer according to claim 7, wherein the first arm portion curves downwardly and to the left and the second arm portion curves upwardly and to the right.

9. A bowstring silencer according to claim 1, wherein the first arm portion curves downwardly and to the left and the second arm portion curves upwardly and to the right.

10. A bowstring silencer according to claim 1, and further comprising an enlarged tip located at an outer free end of each arm portion.

11. A bowstring silencer according to claim 10, wherein the enlarged tips are spherical in shape with a third diameter equal to or less than the first diameter.

12. A bowstring silencer for mounting to a bowstring, buss cable or the like, comprising:

a central body portion having an opening with a first diameter;

a first base extending from one side of the central body portion, the first base having an annular groove that receives the bowstring, buss cable or the like during installation and wraps therearound when installed thereon;

a locking flange extending from the base portion and having a second diameter larger than the first diameter such that the first base portion can be wrapped around the bowstring and inserted into the opening with the locking flange passing therethrough to thereby lock the first base to the central body portion and secure the bowstring silencer around the bowstring, buss cable or the like;

a first arm portion connected to the locking flange and curving downwardly and to the left therefrom; and a second arm portion connected to an opposite side of the central body portion and curving downwardly and to the right therefrom;

wherein the first and second arm portions extend asymmetrically with respect to the central body portion prior to attachment to a bowstring, buss cable or the like, and extend symmetrically after attachment thereto.

13. A bowstring silencer according to claim 12, and further comprising an enlarged tip located at an outer free end of each arm portion.

14. A bowstring silencer according to claim 13, wherein the enlarged tips are spherical in shape with a third diameter equal to or less than the first diameter.

15. A method of installing a bowstring silencer on a bowstring, buss cable or the like, the method comprising:

providing a bowstring silencer with a central body portion having an opening, a first arm portion extending from one side of the central body portion and having a base and a locking flange greater in diameter than the opening, and a second arm portion extending from another side of the central body portion;

wrapping the base around the bowstring, buss cable or the like;

inserting the first arm portion into the opening; and pulling on the first arm portion until the locking flange clears the opening and locks the first arm portion to the central body portion such that the first and second arm portions are generally symmetrical about the central body portion.

* * * * *